US007344137B2

(12) United States Patent
Loke

(10) Patent No.: US 7,344,137 B2
(45) Date of Patent: Mar. 18, 2008

(54) ALPHABET CHALLENGE DECK

(76) Inventor: Jason Loke, Blk 332, #02-118 Clementi Ave 2, Singapore (SG) 120332

( * ) Notice: Subject to any disclaimer, the term of this patent is extended or adjusted under 35 U.S.C. 154(b) by 0 days.

(21) Appl. No.: 10/808,800

(22) Filed: Mar. 24, 2004

(65) Prior Publication Data

US 2005/0212215 A1 Sep. 29, 2005

(51) Int. Cl.
*A63F 1/00* (2006.01)

(52) U.S. Cl. ..... 273/299; 273/272

(58) Field of Classification Search ..... 273/272, 273/299

See application file for complete search history.

(56) References Cited

U.S. PATENT DOCUMENTS

| | | | | |
|---|---|---|---|---|
| 3,984,108 | A | 10/1976 | Marzo | 273/135 B |
| 4,877,255 | A | 10/1989 | Von Braunhut | 273/299 |
| 5,242,171 | A | 9/1993 | Hata | 273/292 |
| 5,409,237 | A * | 4/1995 | Marcley et al. | 273/299 |
| 5,639,091 | A | 6/1997 | Morales | 273/299 |
| 5,688,126 | A | 11/1997 | Merritt | 434/128 |
| 5,772,209 | A | 6/1998 | Thompson | 273/268 |
| 5,788,503 | A | 8/1998 | Shapiro et al. | 434/172 |
| 6,562,078 | B1 | 5/2003 | Yang et al. | 715/535 |
| 2005/0035549 | A1 * | 2/2005 | Zeng | 273/292 |

OTHER PUBLICATIONS

"Scrabble, Rule of the Game", www.hasbro.com, 1948.*

* cited by examiner

*Primary Examiner*—Benjamin Layno
(74) *Attorney, Agent, or Firm*—Saile Ackerman LLC; Stephen B. Ackerman

(57) ABSTRACT

An alphabet challenge game for a group of players, the game includes a deck of seventy-two cards each having an alphabet indicia on a front face for creating words during a participant's turn. The deck includes wild cards and special function cards to be used by players only after a recognizable first word is formed and cast. Twelve cards are dealt to each player. The indicia distribution for each deck is designed to provide each player a time of entertainment and challenge.

8 Claims, 5 Drawing Sheets

FIG. 3b

NOTES

1-ESTABLISH GROUNDRULES:

o Passport word size, ie, 4 letters, 5, etc.
o Player defines cast word.
o If not a word, impose penalty points.
o Implement point system.
o Miscellaneous rules. (See example in Note 10)

2-The first word cast is a "Passport" must come from the player's hand.

3-Player, must discard one card from hand, next player chooses to use discard or draws a card from the deck.

4-Two types of special cards are included in the deck and labeled respectively * and (.

* is a wild card used to represent any letter and used in any situation.
( is a boomerang card and used to replace any letter from a newly cast word.

5-Two boomerang cards can be usd to remove any letter from a newly cast word and replaced with a letter to form a new word. The removed letter is placed at the bottom of the deck.

6-Three boomerang cards can be used to counter a boomerang card and the hand must have at least three cards remaining excluding the boomerang card. After boomerang card is used, remove it from game.

7-Option 1: Winner is the player with the least penalty point total.
Option 2: Reshuffle all thrown cards to form new deck.

8-Point System o Winning player is awarded a merit point (a possitive point) on the blue circle.
o All other players are awarded a penalty point (a negative point) on the red circle.

9-Standard level of game o The standard passport has four letters (four cards).
o When a word is cast, the player must give meaning of the word.
o When a card word is misspelled or player gave incorrect meaning, the player receives a penalty point.
o Players decide how many games will be played, at the finish, the player with the highest point total is the winner.

10-Example of a miscellaneous rule:

o When playing with more than one deck and a player receives more than three boomerang cards, collect all cards, reshuffle, and redeal to each player.

| ALPHABET | MERIT POINT | PENALTY POINT | QTY |
|---|---|---|---|
| A | 1 | 4 | 4 |
| B | 2 | 3 | 3 |
| C | 2 | 3 | 3 |
| D | 2 | 3 | 3 |
| E | 1 | 4 | 4 |
| F | 2 | 3 | 3 |
| G | 3 | 2 | 2 |
| H | 3 | 2 | 2 |
| I | 1 | 4 | 4 |
| J | 4 | 1 | 1 |
| K | 4 | 1 | 1 |
| L | 3 | 2 | 2 |
| M | 2 | 3 | 3 |
| N | 3 | 2 | 2 |
| O | 1 | 4 | 4 |
| P | 2 | 3 | 3 |
| Q | 4 | 1 | 1 |
| R | 3 | 2 | 2 |
| S | 1 | 4 | 4 |
| T | 2 | 3 | 3 |
| U | 1 | 4 | 4 |
| V | 4 | 1 | 1 |
| W | 3 | 2 | 2 |
| X | 4 | 1 | 1 |
| Y | 4 | 1 | 1 |
| Z | 4 | 1 | 1 |
| * | 0 | 5 | 4 |
| ( | 0 | 5 | 4 |
| TOTAL | | | 72 |

FIG. 4

ALPHABET CHALLENGE DECK

BACKGROUND OF THE INVENTION

1. Technical Field

This invention relates generally to word games, particularly, to forming words from a dealt set of cards, each baring a letter of the alphabet, thereafter, following a given set of rules, providing entertainment and challenge to ones vocabulary adeptness.

2. Description of the Prior Art

A number of word games are marketed that challenge the skill, imagination and vocabulary of opposing players. Most word games that are related to a supporting board with playing pieces that contain alphabet characters strung together to form words on that board. Some games utilize a deck of cards each having one or more letters. Such games are challenging with an educational aspect while providing fun for a group of friends coming together for an evening of enjoyment and socializing.

A word card game disclosed in U.S. Pat. No. 4,877,255 describes playing cards with letter designations in the upper left-hand corner in each of two different invertible positions of the card. There is provided an "information center" giving the letter designation of the card should the card be inverted. Cards are selected and a word must be formed with the cards being able to be positioned in either of their two inverted positions. After the word is formed, the word is then used as an acronym in the formation of a sentence, with the sentence preferable being associated with the word itself.

SUMMARY OF THE INVENTION

The present invention includes a card game utilizing seventy-two cards in a deck; each labeled with a letter of the alphabet. Two additional cards are added, each having a specially marked character. The distribution of the letters and specially marked characters are as follows:

Four of each vowel (a,e,i,o,u).
Four of the letter S.
Four of each of the specially marked characters * and (.
Three of each of the letters B, C, D, F, M, P and T.
Two of each of the letters G, H, L, N, R and W.
One each of the letters J, K, Q, V, X, Y and Z.

The game can be played with one deck of 72 cards by two to four players. Five to eight players would require 2 decks, and a party of nine to twelve players requires 3 decks. Prior to starting the game, ground rules of the game should be established. The rules must be understood and agreed by all participants. To start the game, a selected first player is named. A clock-wise rotation, as typically done when playing "bridge", "poker" etc, determines the second, third, etc, and last player in the group. The last player shuffles the deck, deals out twelve cards to each player, starting with the first player, and lastly including self, then places the remaining cards, face down, at the center of the playing table.

The first player draws a card from the deck and forms (casts) a word. The first word cast is designated a "first word" and must be cast from each player's hand during their turn. The number of cards (letters) to form a first word is decided at the beginning and agreed to by all players. A standard first word is compiled of four cards (example: an "H" card, an "E", an "A", and a "T" card spelling the word "HEAT"). If the word cast is not a known word and not in the dictionary, the player must discard a card from his or her hand. The next player may choose to use the discard or to draw a card from the deck, however, the discard can only be taken if the player had firstly cast a recognized first word. The player forfeits his/her turn if the choice is to keep the discard. If the choice is to draw a card from the deck, the player repeats the cycle of forming words, etc.

When a word is cast, another player may cast an "S" card to the cast word "HEAT", changing it a plural version "HEATS". This can only be done if the other player had previously cast his/her first word.

It the deck is used up before the game ends; there are two options. The first option that is for all players to count their points, the least total penalty points is the winner. The second option is for the current player to reshuffle all the discards, placing them face down to form a new deck. Play continues until one of the players completes his/her hand and wins the game.

Two special cards are included. It is optional whether the players decide to use one or both of these special cards. The cards are designated "wild" cards and "special function" cards. There are four wild cards in a deck. Each is labeled "*" and used to replace any letter in the alphabet and for any situation.

There are also four "special function" cards in a deck, each is labeled "(". If a player is dealt one special function card, that player can use it to replace any letter from a word that had just been cast and immediately forms a word to be cast. When casting the word with the special function card, the player must have three cards in the hand, excluding the special function card. After using the special function card, the card must be removed from the game.

If dealt two special function cards, the player may use the cards to sabotage a word that had just been cast by removing a letter and placing it at the bottom of the deck. The player who had formed and cast the word must think of a way to replace the missing letter to form a new word. If not, the player must pick up the remaining cards while drawing one from the deck. When casting a word using the special function card, the player must have three cards in the hand, excluding the special function card. After using the special function cards, the cards must be removed from the game.

If dealt three special function cards, the player can use the cards to counter a special function card applied by another player. As before, the player must have three cards in the hand, excluding the special function card. After using the special function cards, the cards must be removed from the game.

A score keeper is selected to record penalty/merit points after each player's name. For example, the point system could be as follows:

Each player starts the game with 30 points.

When casting a word found to be wrong spelling or player stated wrong meaning, player will receive penalty points.

Players to decide how many games to be played. The point total at the end of the games determines the winner.

In view of the prior art, it is an object of the present invention is to provide a word game that is socially entertaining for a large group to participate in while being challenging, resourceful, and educational.

These and further constructional and operational characteristics of the invention will be more evident from the detailed description given hereafter with reference to the figures of the accompanying drawings which illustrate preferred embodiments and alternatives by way of non-limiting examples.

DESCRIPTION OF THE DRAWINGS

FIG. 3*b* is a listing of notes explaining the rules of the game.

FIG. 4 is a chart showing the distribution of merit and penalty points, and number of cards associated with each card of the deck

DETAILED DESCRIPTION OF THE PREFERRED EMBODIMENT

Figure 1:
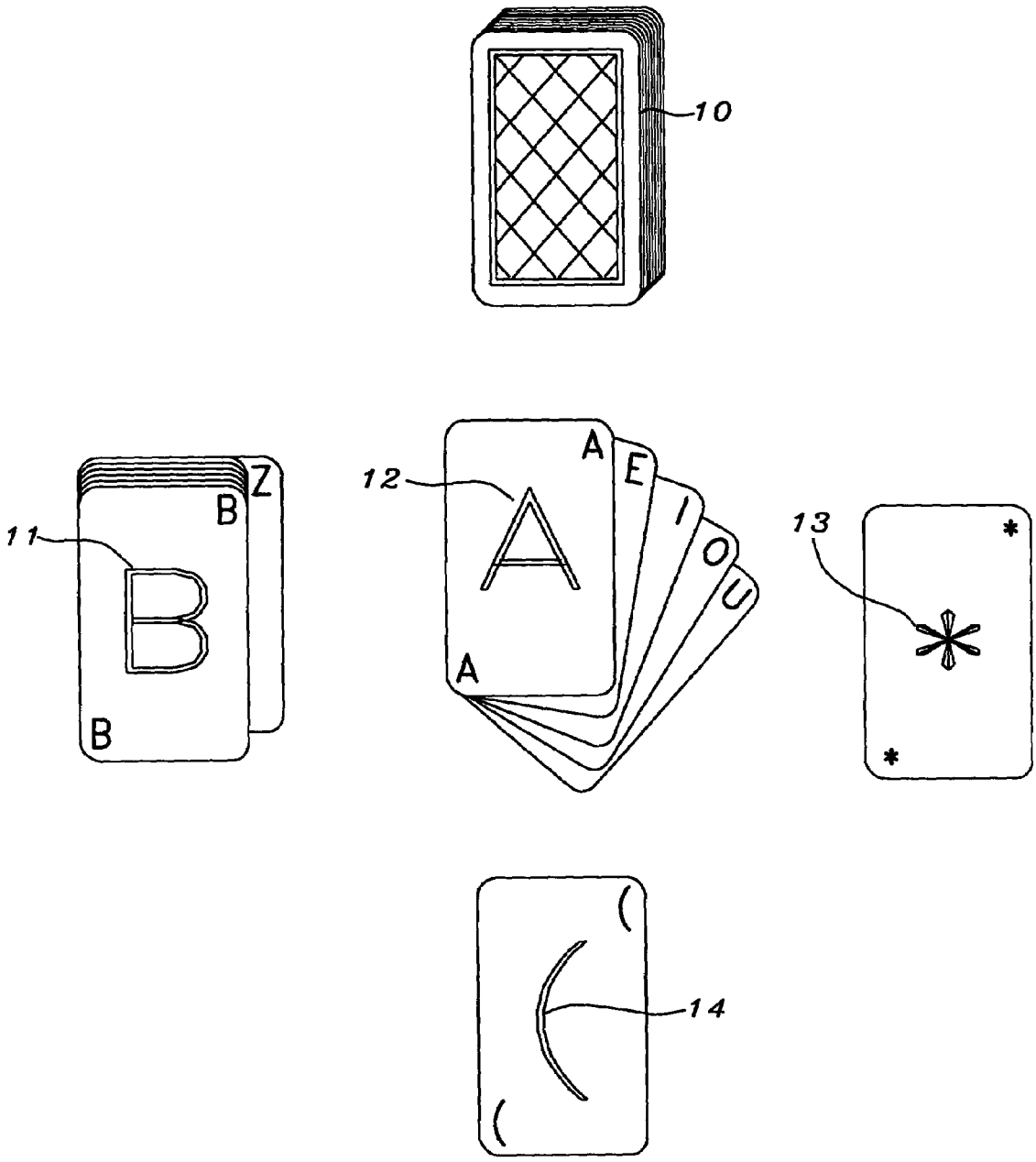
FIG. 1 is an illustration of a typical deck of cards of the invention.

Referring to FIG. 1, the present invention includes a card game utilizing seventy-two cards in a playing deck 10, each labeled with a letter 11 and 12 of the alphabet. Two additional cards are added, each having a specially marked character 13 and 14. The distribution of the letters and specially marked characters are as follows:

Four of each vowel (a,e,i,o,u) contained in stack 12.

Four of the letter S contained in stack of consonants shown as stacks 11.

Four of each of the specially marked characters "*" 13 and "(" 14.

Three of each of the letters B, C, D, F, M, P and T contained in stacks 11.

Two of each of the letters G, H, L, N, R and W contained in stacks 11.

One each of the letters J, K, Q, V, X, Y and Z contained in stack 11.

Figure 2:
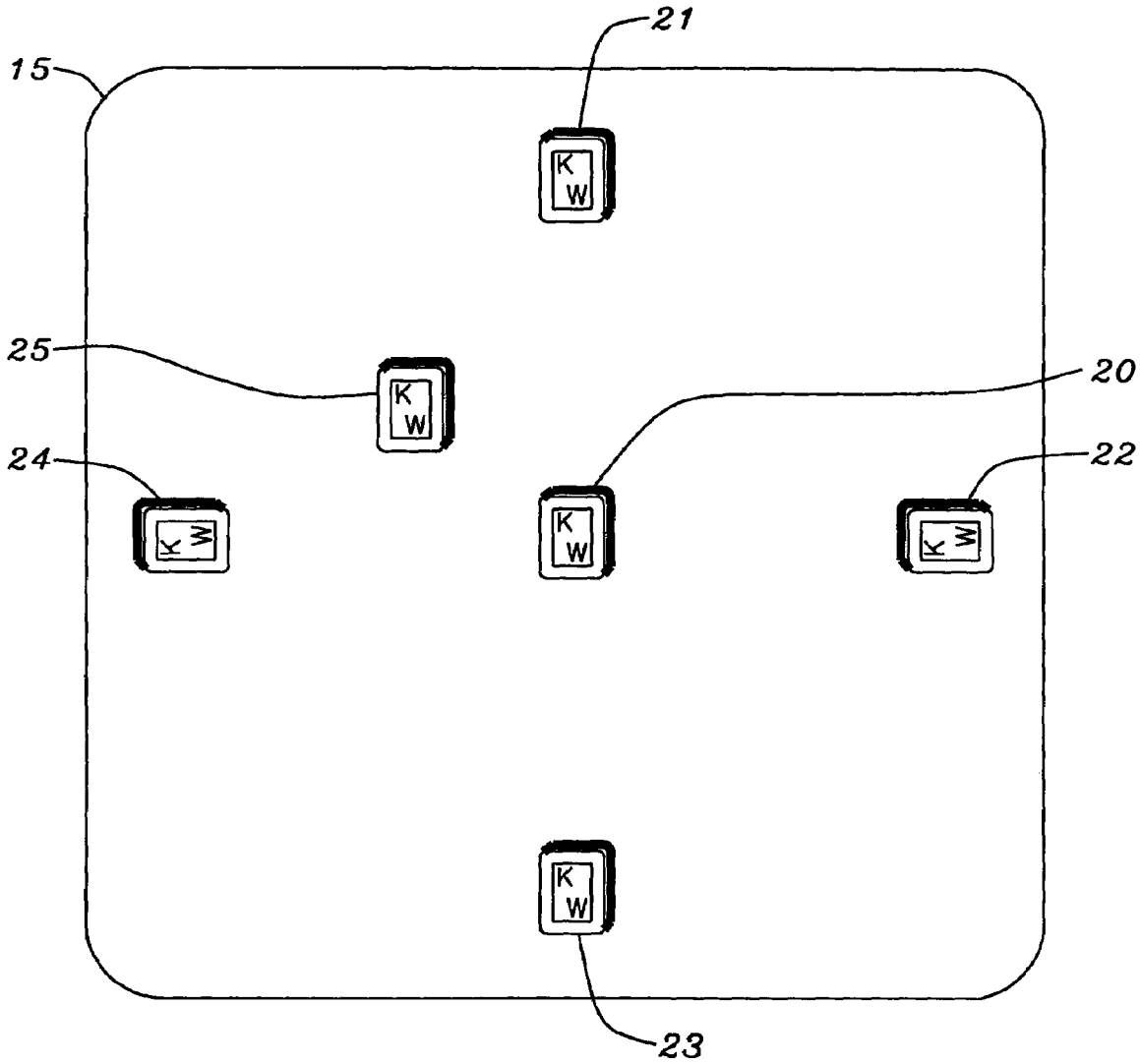
FIG. 2 is a top view of a conventional card table showing a party of four playing hands.
Figure 3A:
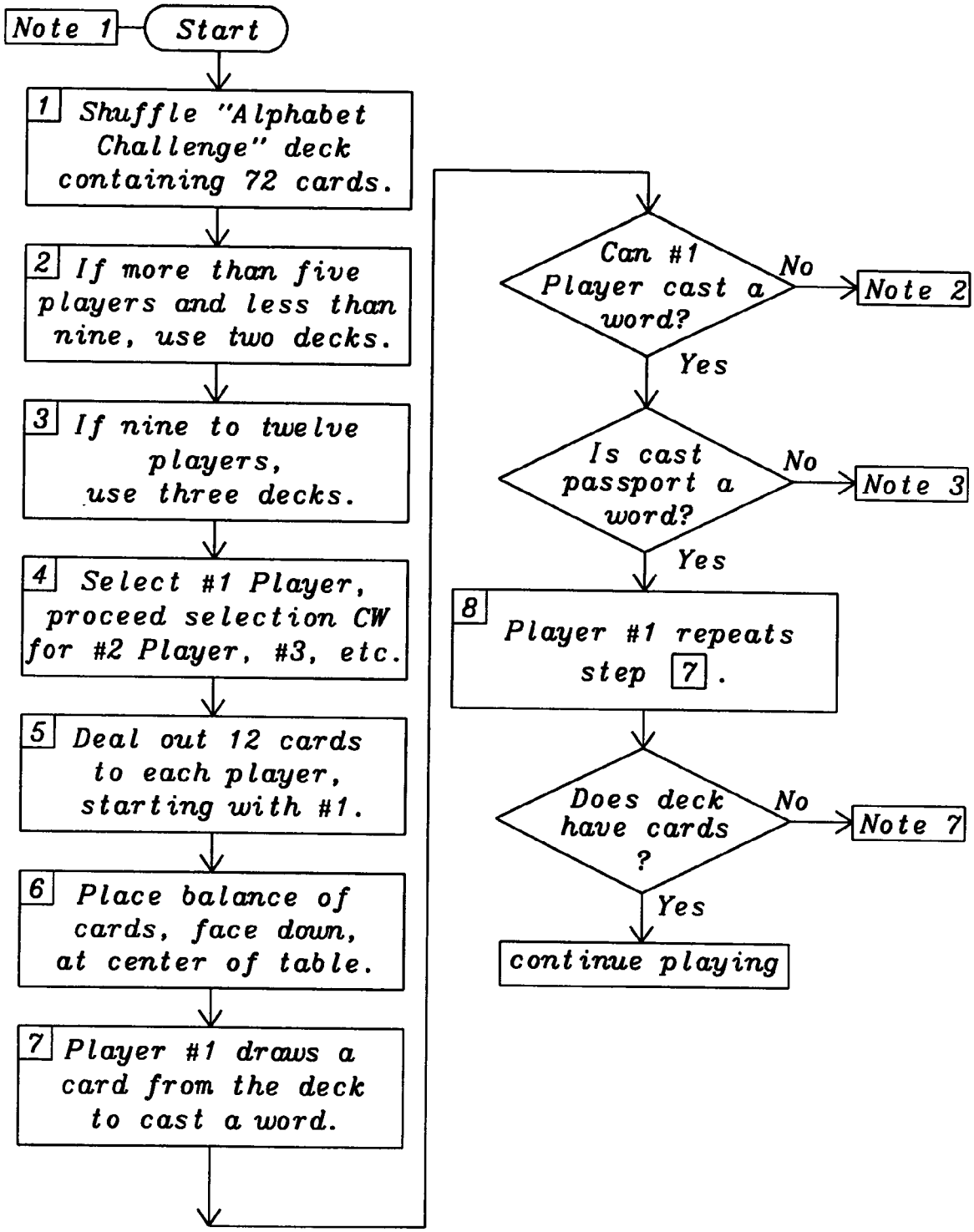
FIG. 3*a* is a chart depicting the flow sequence of the game.

The game can be played with one alphabet challenge deck 10 of seventy two cards by two to four players, as the dealt hands shown in the player positions 21, 22, 23, and 24, on playing surface 15, in FIG. 2. Five to eight players would require two alphabet challenge decks, and a party of nine to twelve players requires three of the alphabet challenge decks. Prior to starting the game, ground rules of the game should be established. The rules must be understood and agreed by all participants. To start the game, a selected first player 21 is named. A clock-wise rotation, as typically done when playing "bridge", "poker" etc, determines the second 22, third 23, etc, and last player 24 in the group. The last player 24 shuffles the alphabet challenge deck 10, deals out twelve cards to each player, starting with the first player 21, and lastly including self, then places the remaining cards 20, face down, at the center of the playing table 15. Refer to FIGS. 1, 2, 3*a* and 3*b*. FIGS. 3*a* and 3*b* respectively depict the flow sequence and rules of the game.

The first player 21 draws a card from the deck 20 and forms and casts a word. The first word cast is designated a "first word" and must be cast from each player's hand during their turn. The number of cards (letters) to form a first word is decided at the beginning and agreed to by all players 21-24. A standard first word is formed using four cards (example: an "H" card, an "E", an "A", and a "T" card spelling the word "HEAT"). If the word cast is not a known word and not in the dictionary, player 21 must discard a card from his or her hand and place it on a discard location 25. Player 22 may choose to use the discard or to draw a card from the deck 20, however, the discard can only be taken if the player 21 had cast a recognized first word. The player forfeits his/her turn if the choice is to keep the discard. If the choice is to draw a card from the deck 20, the player 21 repeats the sequence of forming words as indicated by step 7 in FIGS. 3*a* and 3*b*.

When a word is cast, another player may cast an "S" card to the cast word "HEAT", changing it to a plural form "HEATS". This can only be done if the other player had previously cast his/her first word.

It the deck 20 is used up before the game ends, there are two options. The first option is for all players 21, 22, 23, and 24 to count their points, the least total penalty points is the winner. The second options that are for the current player to reshuffle all the discards in stack 25, placing them face down to form a new deck at the center. Play continues until one of the players completes his/her hand and wins the game.

Two special cards 13 and 14 are included. It is optional whether the players decide to use one or both of these special cards. The cards are designated "Wild" cards 13 and "special function" cards 14. There are four wild cards are a deck. Each is labeled "*" and used to replace any letter in the alphabet and for any situation.

There are also four "special function" cards 14 in a deck, each is labeled "(". If a player is dealt one special function card, that player can use it to replace any letter from a word that had just been cast and immediately forms a word to be cast. When casting the word using the special function card, the player must have three cards in the hand, excluding the special function card. After using the special function card, the card must be removed from the game and placed at a location away from deck 20 and discard 25 location.

If dealt two special function cards, they can be used to sabotage a word that had just been cast by removing a letter and placing it at the bottom of the deck. The player must think of a way to replace the missing letter to form a new word. If not, the player must take the remaining cards and draws one from the deck. When casting the word using the special function card, the player must have three cards in the hand, excluding the special function card. After using the special function cards, the cards must be removed from the game.

If dealt three special function cards, they can be applied to counter a special function card used by another player. As before, the player must have three cards in the hand, excluding the special function card, before applying its counter power. After applying the special function cards, the cards must be removed from the game.

A score keeper is selected to record penalty/merit points (see FIG. 4) after each player's name.

Guide for applying the point system may be as follows:

a) Each player starts the game with 30 points.

b) When casting a word found to be wrong spelling or player stated wrong meaning, player will receive penalty points.

c) Players to decide how many games to be played. The point total at the end of the games determines the winner.

In summary, the game includes the sequence of steps of providing one deck of alphabet challenge cards for two to four players, providing two decks for five to nine players while removing two of the special function cards and providing three decks for 9 to 12 players minus two of the special function cards from two of the decks. Each deck has seventy two cards including a combination of sixty four cards having on its face an alphabet indicia for creating words, and four wild cards, and four special function cards, each having identifying markings on its face. The special function cards are referred to as "Boomerang Cards". Prior to starting play, ground rules are established that describe uses of the wild cards and the special function cards. A score keeper is selected.

The deck of cards are shuffled and twelve cards are dealt to each player, starting with a designated first player and placing the remaining cards, face down to establish a draw pile. The dealer removes the top card from the draw pile and places the top card face up to start a discard pile. The designated first player draws a card, either from the draw pile, or from the discard pile and forms a word to be cast. After a first word is cast, the player is permitted to use any of the special function cards. This rule is labeled "passport" which applies to all players during their turn. The score keeper names a winner by determining the player with the least penalty points and awards the winner merit points for winning the game All other players receive demerit points.

While the invention has been particularly shown and described with reference to the preferred embodiments thereof, it will be understood by those skilled in the art that various changes in form and details may be made without departing from the spirit and scope of the invention.

What is claimed is:

1. A method of playing an alphabet challenge game for a group of players, comprising the steps of:

providing a deck of alphabet challenge cards for two to four players, each deck comprising seventy two cards, including a combination of sixty four cards having on its face an alphabet indicia for creating words, and four wild cards, and four special function cards, each having identifying markings on its face;

establishing ground rules that describe applications of said wild cards and special function cards and, selecting a score keeper;

shuffling said decks of cards and dealing twelve cards to each player, starting with a designated first player and placing the remaining cards, face down to establish a draw pile;

a player receiving a single special function card in a dealt hand permits said player to replace any letter in a word previously cast by an opposing player, said opposing player must immediately form and cast another word, a player receiving two special function cards in a dealt hand, permits said player to remove one letter from a word previously cast by an opposing player and placing said removed letter to bottom of deck, said opposing player must provide a replacement letter to form another word, and, a player receiving three of said special function cards in a dealt hand; permits said player to counter an opposing player's use of said special function card;

removing a top card from said draw pile and placing said top card face up to start a discard pile;

said designated first player draws a card either from the draw pile or from the discard pile and forms a word to be cast, after a first word is cast, player is permitted to use any of said special function cards, this rule labeled "passport" applies to all players during their turn;

if said first player cannot cast a word, said player forfeits turn to a next player;

said next player repeats the word forming sequence;

player who completes a last cast word by drawing from said draw pile or a top card from said discard pile, finishes the game, and a winner is named for the player holding the least total penalty points.

2. The method of claim 1, wherein the cards containing alphabet indicia appear with the following frequency:

Four of the letter S:

Four wild cards, and four special function cards;

Three of each of the letters B, C, D, F, M, P and T;

Two of each of the letters G, H, L, N, R and W;

One each of the letters J, K, Q, V, X, Y and Z.

3. The method of claim 1, wherein said wild card may be used to substitute for any letter of the alphabet.

4. The method of claim 1, wherein said player using said special function cards must have at least three remaining cards in hand, excluding said special function card, and, after using said cards must remove cards from game.

5. The method of claim 1 wherein all players must state meaning of a cast word otherwise penalty points will be assessed to the player if a cast word is not a known word, thereupon, player will forfeit turn to next player.

6. The method of claim 1 wherein a point system is provided to establish a winner, each player starts the game with 30 points, said score keeper tallies each player's penalty points and the player with the lease penalty points is the winner and receives a positive merit point all other players receive a negative demerit point, said point system comprising:

merit points weighted from zero to four for each alphabet indicia;

penalty points weighted from 1 to five for each alphabet indicia, including said special function cards.

7. The method of claim 1 wherein said player who completes a last cast word, and if the deck is used up before said game ends, one of two options is allowed:

the scorekeeper tallies each player's points, the player with the least penalty point total is the winner, or the current player reshuffles all cards in said discard stack, placing face down to form a new draw pile and continues playing until one of said players casts the last possible word to be formed therein, ending the game and permitting the scorekeeper to tally the points to name the winner.

8. The method of claim 1 wherein said group of players decides rules of said alphabet challenge game, further comprising the steps of:

first cast word size, four, five or larger;

whether player must state meaning of word when casting said word;

what is penalty if cast word is not a word;

implement a point system giving each player an agreed number of points at start of game;

define word category to be used such as a category selected from the group consisting of animal, vegetable, names or other agreed upon categories.

* * * * *

UNITED STATES PATENT AND TRADEMARK OFFICE

CERTIFICATE OF CORRECTION

PATENT NO. : 7,344,137 B2
APPLICATION NO. : 10/808800
DATED : March 18, 2008
INVENTOR(S) : Jason Loke It is certified that error appears in the above-identified patent and that said Letters Patent is hereby corrected as shown below:

In Column 1, Background of the Invention, 1. Technical Field, line 7 delete "each baring" and replace with -- each bearing --. In the Claims, Column 6, Claim 6, Line 27 delete "the lease penalty points is" and replace with -- the least penalty points is --.

Signed and Sealed this

Twenty-ninth Day of July, 2008

JON W. DUDAS
*Director of the United States Patent and Trademark Office*